US009521908B1

(12) United States Patent
Beck et al.

(10) Patent No.: US 9,521,908 B1
(45) Date of Patent: Dec. 20, 2016

(54) HEAD REST FOR CHAIR

(71) Applicant: BeckFoley LLC, Holland, MI (US)

(72) Inventors: Robert L. Beck, Zeeland, MI (US); Dennis J. Foley, Holland, MI (US)

(73) Assignee: BECKFOLEY LLC, Holland, MI (US)

( * ) Notice: Subject to any disclaimer, the term of this patent is extended or adjusted under 35 U.S.C. 154(b) by 34 days.

(21) Appl. No.: 14/336,475

(22) Filed: Jul. 21, 2014

Related U.S. Application Data

(60) Provisional application No. 61/857,006, filed on Jul. 22, 2013.

(51) Int. Cl.
*A47C 1/10* (2006.01)
*A47C 7/38* (2006.01)
*A47C 3/00* (2006.01)

(52) U.S. Cl.
CPC .. *A47C 7/38* (2013.01); *A47C 3/00* (2013.01)

(58) Field of Classification Search
CPC ..... A47C 1/10; A47C 7/38; A47C 7/383
USPC ..... 297/400, 406–410, 397
See application file for complete search history.

(56) References Cited

U.S. PATENT DOCUMENTS 242,380 A * 5/1881 Sharp ..... B60N 2/4879 297/400
619,272 A * 2/1899 Browne ..... A47C 7/38 297/405
1,746,091 A * 2/1930 Skidmore ..... A47C 1/10 297/222
2,492,383 A * 12/1949 Jones ..... A61B 19/203 128/845
2,831,530 A * 4/1958 Chiopelas ..... B60N 2/4817 297/397
3,497,259 A * 2/1970 Sherfey ..... A61G 5/12 297/391
3,877,751 A * 4/1975 Rasmussen ..... A61G 15/125 297/408
3,885,831 A * 5/1975 Rasmussen ..... A47C 7/38 297/405
5,967,613 A * 10/1999 McKeever ..... A61G 5/12 297/397
6,857,704 B2 * 2/2005 Stenzel ..... A47C 7/38 297/408
7,494,188 B1 * 2/2009 Lin ..... A47C 7/383 297/397
7,690,729 B2 * 4/2010 Liao ..... A47C 7/38 297/408
8,662,591 B2 * 3/2014 Lin ..... A47C 7/38 297/391
2012/0104807 A1 * 5/2012 Lauchle ..... A47C 7/383 297/180.11

(Continued)

*Primary Examiner* — Laurie K Cranmer
(74) *Attorney, Agent, or Firm* — McGarry Bair PC

(57) ABSTRACT

A head rest assembly for a chair includes a head rest that can be adjusted in as many as three manners, such as rotational, horizontal, and/or vertical adjustment, with respect to a chair in a generally upright orientation, to achieve a desired position. The user can adjust the position of the head rest by grasping the head rest and applying force(s) in the desired directions(s), and the head rest remains in the desired position by friction, without needing to actuate any levers, knobs, and the like. Further, the head rest can have an outer surface with variable radii of curvature, and the assembly can be removably mounted to a chair.

14 Claims, 11 Drawing Sheets

(56) References Cited

U.S. PATENT DOCUMENTS

2013/0069411 A1* 3/2013 Walker ..... A47C 7/38
297/391

* cited by examiner

HEAD REST FOR CHAIR

CROSS-REFERENCE TO RELATED APPLICATION

This application claims the benefit of U.S. Provisional Patent Application No. 61/857,006, filed Jul. 22, 2013, which is incorporated herein by reference in its entirety.

BACKGROUND

Many types of chairs, such as desk chairs and side chairs, provide support for a user's back but lack a head rest. Absence of a head rest can be uncomfortable and ultimately lead to head and/or neck pain, especially if the user sits in the chair for long durations. Existing head rests that can be attached to a chair offer adjustable support for a user's head but can have complex designs and adjusting mechanisms or lack meaningful adjustment.

BRIEF SUMMARY

A head rest assembly according to one embodiment comprises a head rest coupled to an upright support by a transverse support. The upright support can be mounted to a chair by a bracket.

In one embodiment, the head rest can be pivotally mounted to the transverse support, which can be in the form of a U-shaped bar. The tension of the pivot connection between the bar and the head rest can be adjustable such that a reduction in the tension allows easier pivotal movement of the head rest relative to the bar, while an increase in the tension increases the force required for pivotal movement of the head rest. Once adjustment is set for the individual, further tension adjustment or locking is not required. Once desired pivotal tension is obtained, the pivotal tension remains constant, providing smooth movement as desired by the user. Locking is not required, tension holds the headrest in position. This frictional tension is similar in nature to all 3 degrees of freedom, i.e., the pivoting cushion, the horizontal slide movement and the vertical slide movement.

In another embodiment, the transverse support can be movable relative to the upright support so as to horizontally adjust the position of the head rest with respect to the chair in a generally upright position. For example, the transverse support can be coupled to the upright support by a clamp, and a reduction in the clamping force allows transverse sliding movement of the transverse support and, thereby, the head rest. An increase in the clamping force secures the transverse support and, thereby, the head rest in a desired transverse position.

In yet another embodiment, the bracket can be slidable relative to the upright support. The bracket can include a depending U-shaped bar, and the upright support can include a clamp coupled to the bar. A reduction in the clamping force allows vertical movement, relative to the chair in a generally upright position, of the upright support and, thereby, the head rest relative to the bracket mounted to the chair and the bar mounted to the bracket. An increase in the clamping force secures the upright support to the bar and, thereby, fixes the head rest in a desired vertical position. The bracket can be configured to clamp onto the chair to mount the head rest assembly to the chair.

In one embodiment, the head rest can have a contoured surface. The contoured surface can have variable radii of curvature. For example, along a horizontal reference line, the head rest can have a concave center portion the transitions to convex outer portions. Along a generally vertical reference line, the head rest can be convex at both the center portion and the outer portions, with the radius of curvature smallest at an upper central portion increasing moving to a lower central portion.

Further according to the invention, a head rest assembly mountable to a chair comprising a seat and a back extending upwardly from the seat, the head rest assembly comprising: an upright support; a bracket coupled to the upright support and configured to mount to the chair back to mount the head rest assembly to the chair back with the upright support in a generally upright orientation when the chair back is in an upright position, wherein the upright support is coupled to the bracket for selective upward and downward movement relative to the bracket; a transverse support slidably mounted to the upright support for forward and rearward movement relative to the upright support; and a head rest mounted to the transverse support above the chair back for supporting a head of a user sitting in the chair when the head rest assembly is mounted to the chair back, wherein the head rest can be adjusted upward and downward by moving the upright support relative to the bracket and adjusted forward and backward by moving the transverse support relative to the upright support.

In one embodiment, the head rest is pivotally mounted to the transverse support for rotational adjustment of the head rest with respect to the transverse support. Optionally, the pivot mounting of the head rest to the transverse support constitutes a first friction joint that selectively holds the head rest at a desired rotational position with a selected frictional resistance force.

Further according to the invention, a head rest assembly mountable to a chair comprises a seat and a back extending upwardly from the seat, the head rest assembly comprising; an adjustable head rest and a support coupled to the head rest and mountable to the chair back to mount the head rest to the chair, the support including a first friction joint selectively holding the head rest in a desired vertical use position with a frictional resistance force and a second friction joint frictionally holding the head rest in a desired fore-aft use position with a frictional resistance force, wherein the frictional forces are selected to maintain the head rest in the desired vertical and fore-aft use positions during normal use and so that movement of the head rest from at least one of the desired vertical position and the desired fore-aft position can be effected by solely applying user force directly to the head rest to overcome the corresponding selected frictional resistance force without the use of tools and without adjusting the frictional resistance forces.

In another embodiment, the support can be coupled to the head rest at a friction pivot joint that can be adjusted to frictionally hold the head rest with a rotational frictional resistance force to maintain the head rest in a selected rotational position during normal use and so that the movement of the head rest from one desired rotational position to a second rotational position can be effected by solely applying user force directly to the head rest to overcome the rotational frictional resistance force without the use of tools and without adjusting the rotational frictional resistance force.

DETAILED DESCRIPTION

Figure 1:
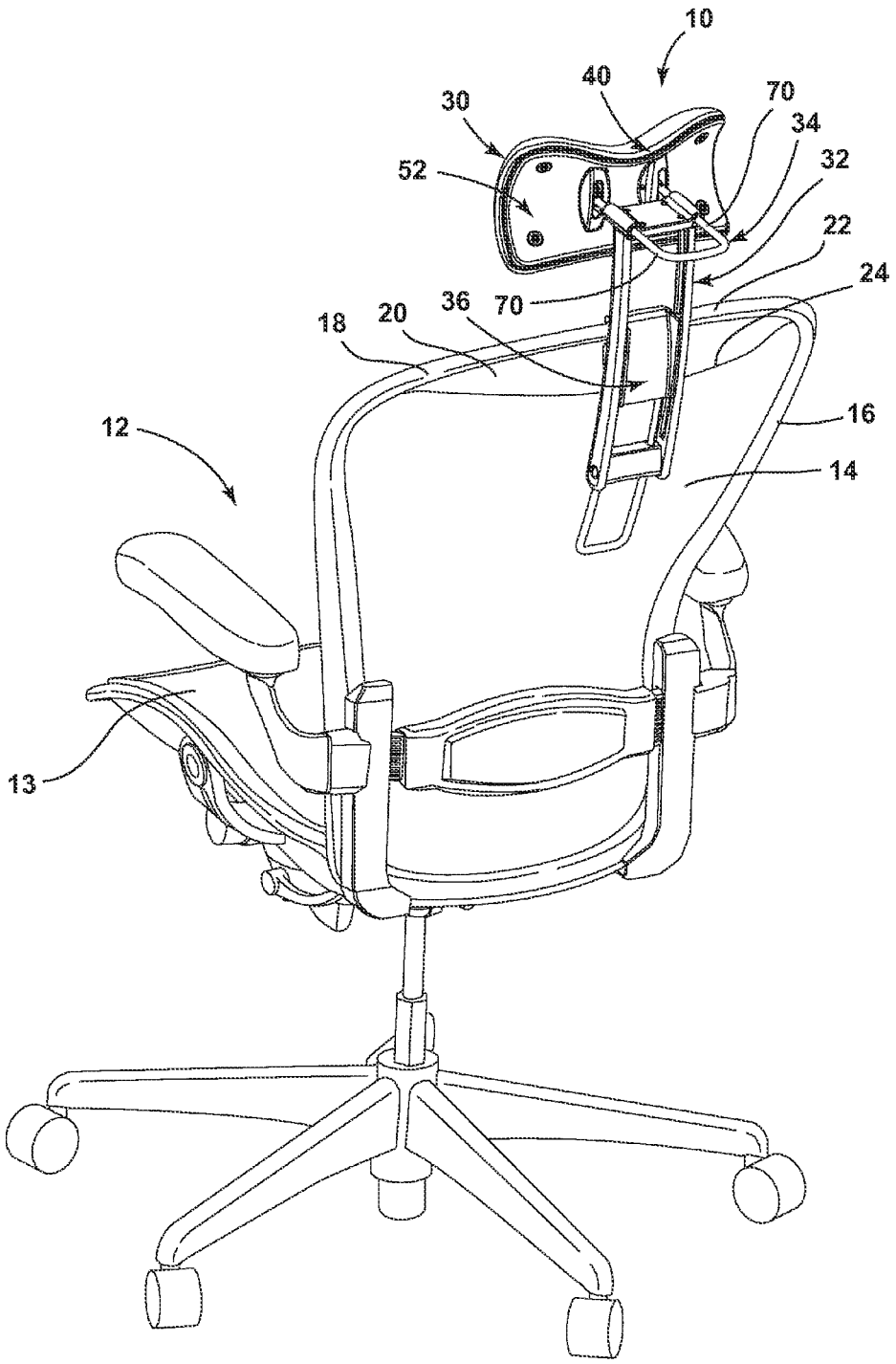
FIG. 1 is a rear perspective view of a head rest assembly according to one embodiment mounted to an exemplary chair.

Referring to FIG. 1, an exemplary embodiment of a head rest assembly 10 is removably and adjustably mounted to a chair 12, shown by example as a desk chair, particularly the Herman Miller® Aeron® chair. The head rest assembly 10 can be configured for use with any type of chair, including other types of desk chairs, side chairs, and other chairs, and is not limited for use with the Aeron chair. The head rest assembly 10 is shown as an accessory for the Aeron chair for exemplary purposes only. The chair 12 includes a seat 13 and a back 14 extending upwardly from a rear end of the seat 13 in a conventional manner. The back 14 of the exemplary chair 12 includes a frame 16 having an upper portion 18 with a depending arcuate wall 20 joining an upper lip 22 and a lower lip 24. The head rest assembly 10 includes a head rest 30 coupled to an upright support 32 (i.e., upright when the chair 12 is in generally upright position) through a transverse support (i.e., transverse to the general orientation of and a longitudinal axis of the upright support 32) in the form of a U-shaped bar 34 oriented at an angle slightly greater than 90°, such as about 91°, relative to the upright support 32. The upright support 32 slidingly receives a mounting bracket 36 that mounts the head rest assembly 10 to the back 14 of the chair 12. When the assembly 10 is mounted to the chair 12, the head rest 30 is positioned above the chair back 14 for supporting a head of a user sitting in the chair 12.

Figure 2:
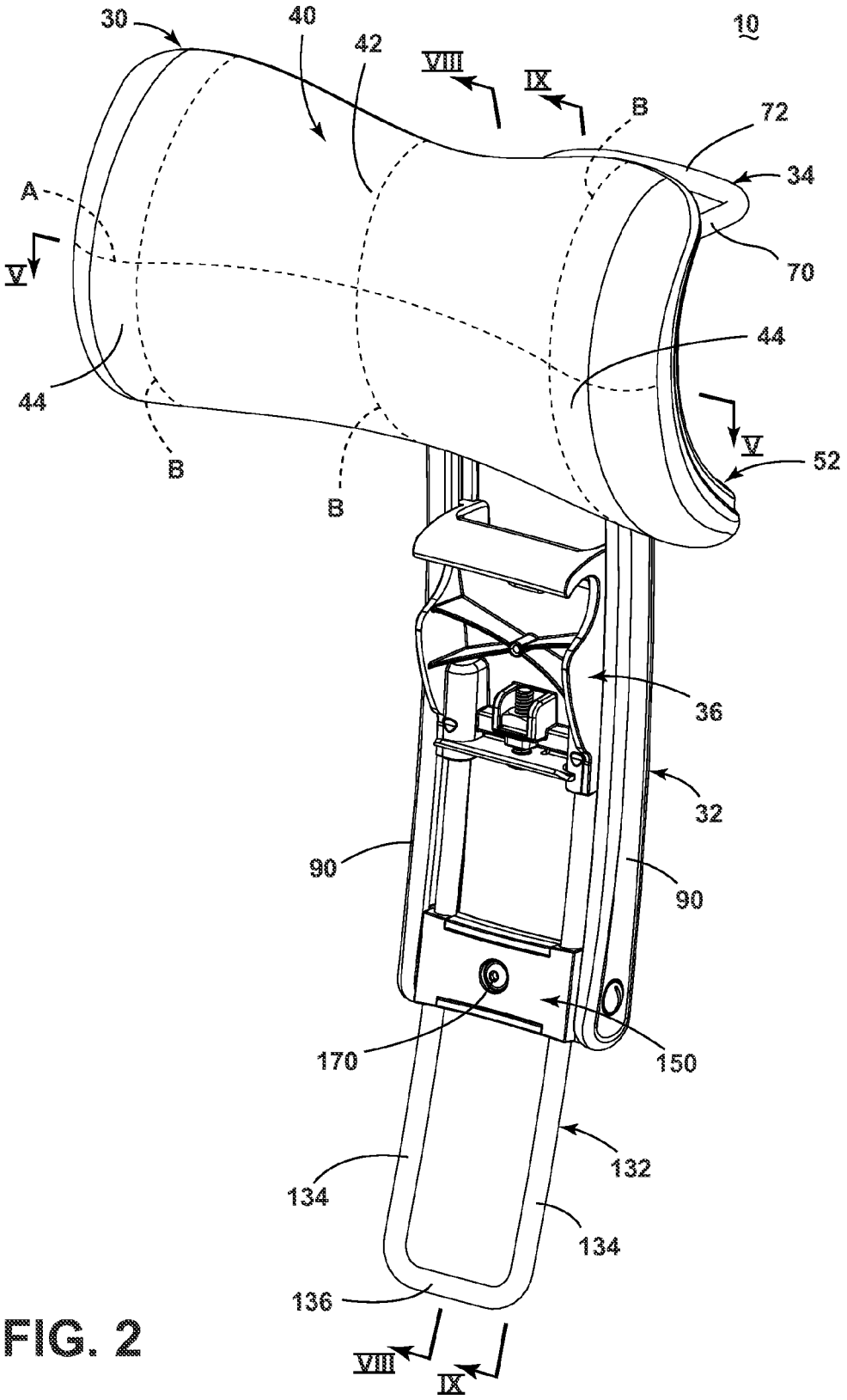
FIG. 2 is a front perspective view of the head rest assembly of FIG. 1.

Referring now to FIG. 2, which is a front perspective view of the head rest assembly 10, the head rest 30 includes a cushion 40 that can be made of, for example, foam and optionally covered with a fabric. The cushion 40 is contoured for support of a user's neck and/or head. To this end, the outer surface of the cushion 40 has variable radii of curvature. Along a generally horizontal direction, as indicated by a line A, a concave center portion 42 transitions to convex outer portions 44 so as to form a valley or cradle at the center portion 42 for receipt of the user's neck and/or head. Along a generally vertical direction, as indicated by lines B, the cushion 40 is convex at both the center portion 42 and the outer portions 44, and the radius of curvature is smallest at the center portion 42 and increases moving to the outer portions 44. Further, along a given vertical line, the radius of curvature is smallest at an upper portion of the cushion 40 and largest at a lower portion of the cushion 40; thus, the radius of curvature may increase moving from the upper portion to the lower portion of the head rest cushion 40. This radius of curvature may range from about 7-8 cm (3 in.) to about 44-45 cm (18 in.). The head rest cushion 40 can have any suitable configuration to support the user's neck and/or head and is not intended to be limited to the shape described above and shown in the figures by example; however, the particular configuration of this embodiment is especially suited for supporting a user's neck and head when the chair is reclined, such as if the user lays back in the chair, almost to a supine position.

Figure 3:
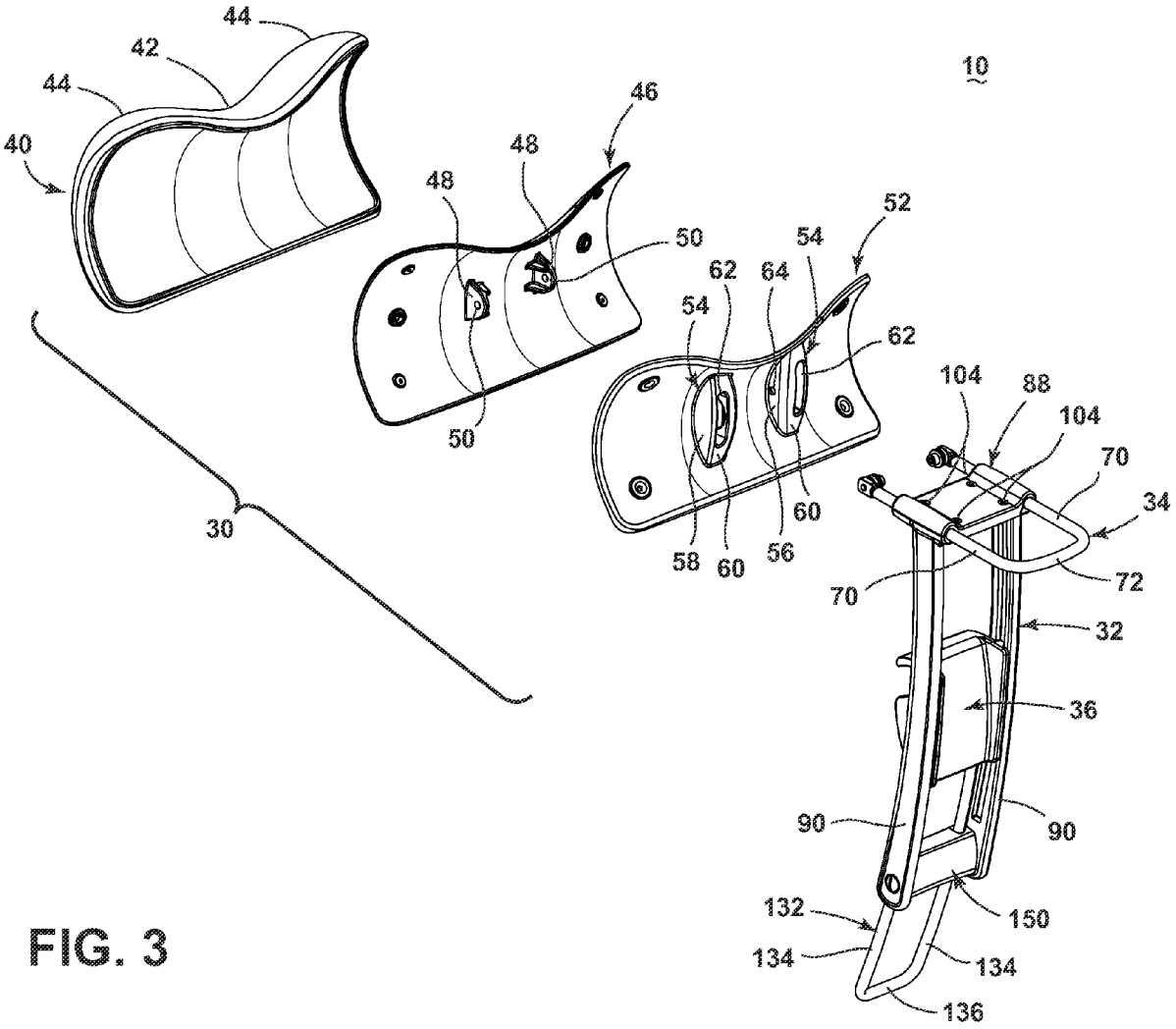
FIG. 3 is a rear perspective view of the head rest assembly of FIG. 1 with a head rest shown as exploded.
Figure 4:
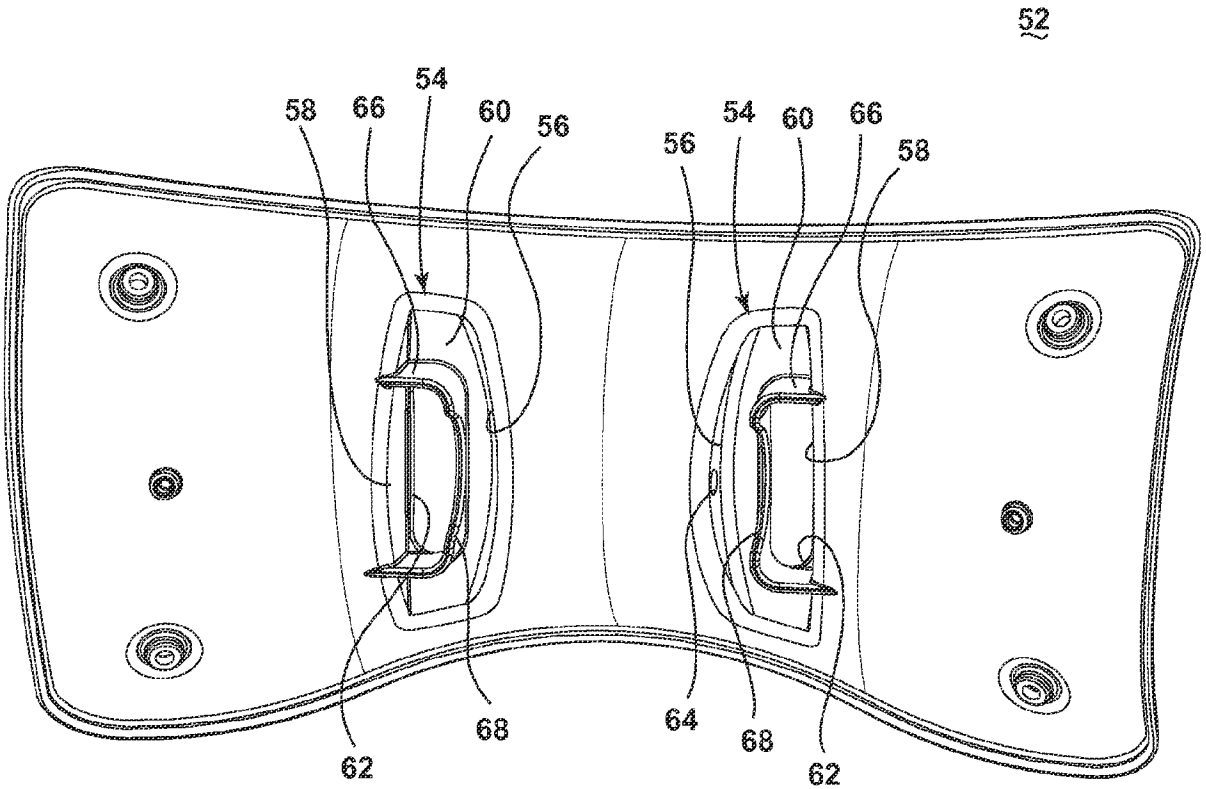
FIG. 4 is a front perspective view of a backing plate from the head rest of FIG. 3.

Turning to FIG. 3, which illustrates the head rest assembly 10 with the head rest 30 in an exploded view, a rigid insert 46 with a pair of rearwardly extending flanges 48, each having an aperture 50, supports the cushion 40 of the head rest 30 and is disposed between the cushion 40 and a backing plate 52. Alternatively, the flanges 48 can be formed as a separate piece mechanically coupled to the insert 46 rather than being integrally formed therewith. The insert 46 and the backing plate 52 are contoured in a manner similar to the cushion 40 and are secured together and to the cushion 40 by mechanical fasteners, such as screws. The backing plate 52 has a pair of protrusions 54 extending rearwardly with opposing inward and outward walls 56, 58 joined by a rear wall 60 and forming a cavity on the opposite side of the backing plate 52 accessible through an elongated opening 62 formed in the rear wall 50. The inward walls 56 each include an aperture 64 that aligns with the corresponding apertures 50 on the insert flanges 48 when the insert flanges 48 are received within the cavities formed by the protrusions 54. As best seen in FIG. 4, a front perspective view of the backing plate 52, the backing plate 52 includes a generally U-shaped wall 66 in each of the cavities formed by the protrusions 54 and depending from the rear wall 60 and the outward wall 58 and surrounding the opening 62. An arcuate seat 68 formed in the wall 66 generally horizontally aligned with the aperture 64 is configured to receive the corresponding flange 48 on the insert 46.

Figure 5:
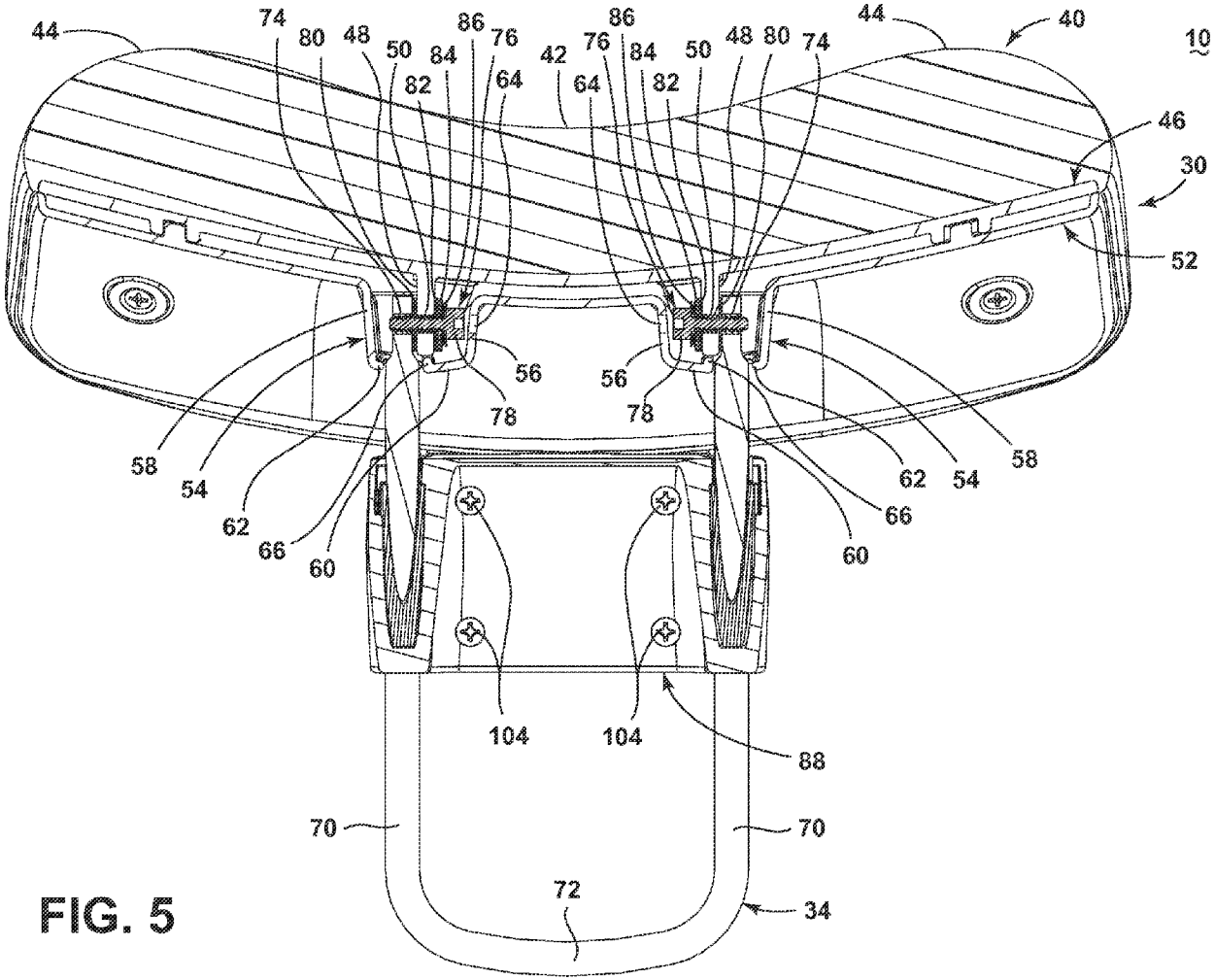
FIG. 5 is a sectional view taken along line V-V of FIG. 2.

Referring now to the FIG. 5 sectional view taken along line V-V of FIG. 2, the head rest 30 is pivotally mounted to the transverse support in the form of the U-shaped bar 34 having legs 70 joined at one end by a bight 72. In particular, the other end of the legs 70 extend through the openings 62 for receipt of the ends of the legs 70 in the cavities formed by the protrusions 54. Threaded apertures 74 formed in the ends of the legs 70 linearly align with the corresponding apertures 50 in the insert flanges 48, which are disposed in the respective seat 68 (FIG. 4) of the wall 66 on the backing plate 52, and the corresponding apertures 64 in the inward walls 56 of the backing plate protrusions 54. A mechanical fastener, such as a hex head socket screw 76, extends through the insert flange aperture 50 and the bar leg threaded aperture 74 with a head 78 residing in a space between the insert flange 48 and the protrusion inward wall 56 in linear alignment with the aperture 64 in the inward wall 56 such that a user can access the head through the aperture 64. A washer 80, which can be made of a natural lubricity bearing material, such as an acetal polymer (e.g., Delrin) and polytetrafluoroethylene (e.g., Teflon®), is positioned between the insert flange 48 and the bar leg 70. On the other side of the insert flange 48, a second washer 82, which can be made of a natural lubricity bearing material, such as an acetal polymer (e.g., Delrin) and polytetrafluoroethylene (e.g., Teflon®), a third washer 84, which can be, for example, a flat steel washer, and a wave washer 86 are disposed between the insert flange 48 and the screw head 78. Such an arrangement forms a friction pivot joint that allows user to easily adjust the position of the headrest 30 with respect to the transverse support 34 by simply gripping the headrest 30 and rotating the headrest with respect to the transverse support 34 without making any adjustment to the joint between the two. Typically, the static frictional resistances are factory set for average body weights. However, the user can optimize or tailor the frictional resistance setting for his or her preference by adjusting the hex head socket screw 76 to increase or reduce the frictional force on the friction pivot joint. Thus, the friction pivot joint allows a user to adjust the static frictional resistance of the pivot mounting of the head rest 30 to the bar 34; with a hex key (i.e., Allen wrench), or other tool corresponding to the particular type of mechanical fastener employed in the pivot mounting, to rotate the screw 76 and, thereby, increase or decrease the static frictional resistance. The screw 76 is secured with a standard thread locking adhesive to impede its rotation and prevent the screw from becoming loose. Other washer arrangements and other pivot connections allowing adjustable static frictional resistance are contemplated for mounting the head rest 30 to the bar 34; the pivot connection is not limited to that described above and shown in the figures.

Figure 6:
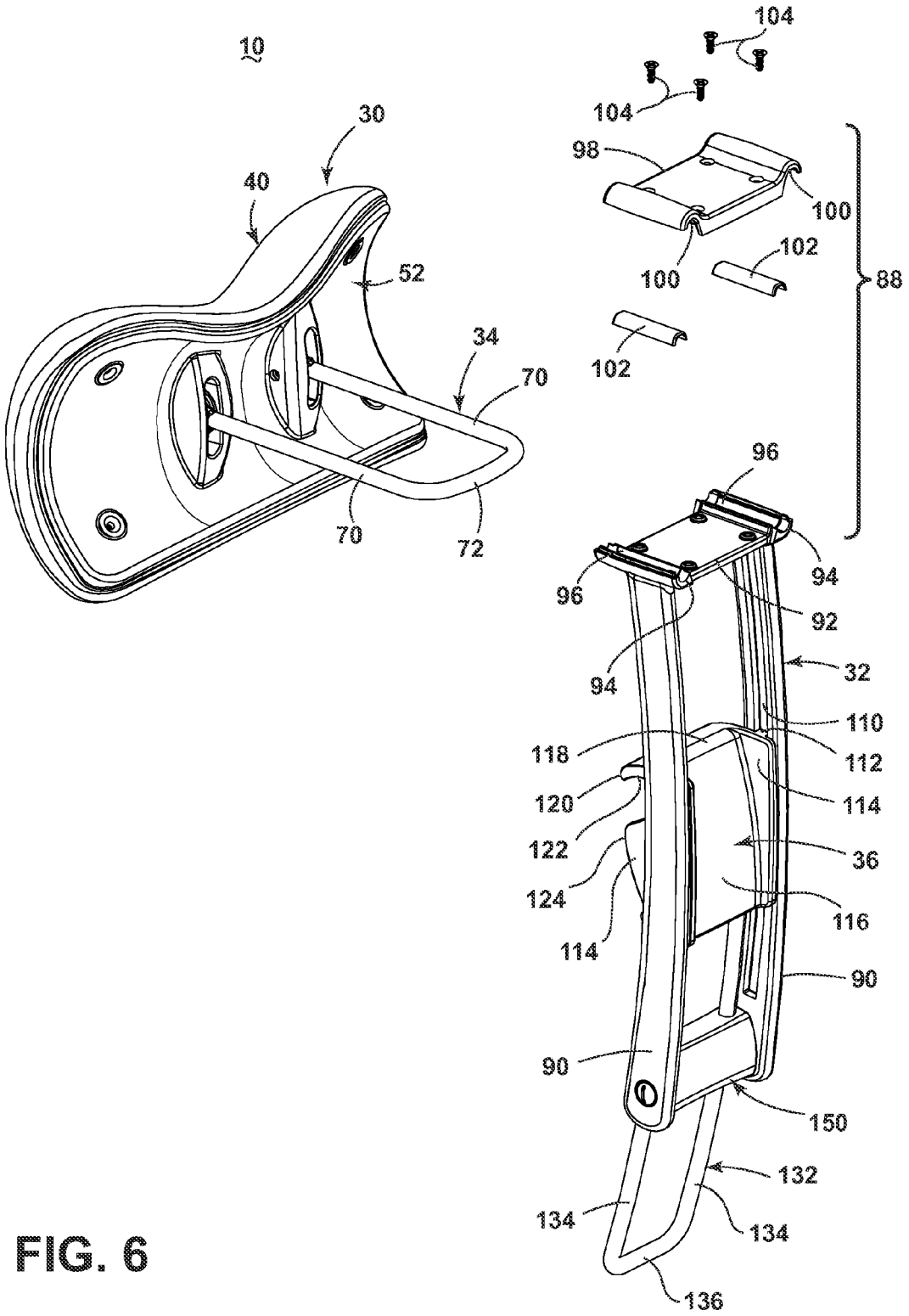
FIG. 6 is a rear perspective view of the head rest assembly of FIG. 1 with a transverse clamping mechanism shown as exploded.

As shown in the rear perspective view of FIG. 6, the bar 34 is mounted to the upright support 32 with a transverse clamp mechanism 88. The upright support 32 includes a pair of spaced upright arms 90 joined at their upper ends by a lower clamp plate 92 forming a pair of semi-circular channels 94, wherein each of the channels 94 is located at the end of a corresponding arm 90 and holds a glide insert 96 shaped in accordance with the channels 94. An upper clamp plate 98 forming a pair of channels 100 complementary to the channels 94 and each holding a glide insert 102 is mounted to the lower clamp plate 92 by mechanical fasteners, such as screws 104. In particular, each of the channels 100 on the upper clamp plate 98 mates with one of the channels 94 on the lower clamp plate 92, and the two sets of the mating channels 94, 100 form a pair of generally circular spaces within which the bar legs 70 sit (FIGS. 1 and 3). The bar legs 70 can selectively slide within the channels 94, 100 forward and rearward to adjust the horizontal or transverse position of the head rest 30, and the screws 104 can be tightened to increase clamping force on the bar 34. The screws 104 set the frictional resistance to hold the head rest 30 horizontally/transversely and can be tightened or loosened to increase or decrease, respectively, the frictional resistance on the bar 34. (The static frictional resistance is greater than the sliding frictional resistance so that the force to slide the bar 34 is less than the force required initially move the bar 34). As the clamping force increases, the force required to move the head rest 30 horizontally increases (i.e., force holding the head rest 30 in the horizontal position increases), while the force required to move the head rest 30 horizontally decreases as the clamping force decreases (i.e., force holding the head rest 30 in the horizontal position decreases). The transverse clamp mechanism 88 essentially forms a selective frictional joint between the upright support 32 and the transverse support in the form of the bar 34, and the screws 104 can be used to adjust the amount of friction that holds the bar 34 in place and that must be overcome to move the bar 34 relative to the upright support 32, if desirable. Optionally, the screws 104 can be sufficiently tightened to effectively lock and, thereby, secure the head rest 30 in a desired horizontal or transverse position.

The channels 94, 100 can be recessed to receive the respective glide inserts 96, 102, which facilitate smooth movement of the bar 34 within the channels 94, 100. The glide inserts 96, 102 can be made of a self-lubricating plastic, such as acetal (e.g., Delrin®) and polytetrafluoroethylene (e.g., Teflon®), to aid in the smooth movement of the bar 34 and to prevent scraping the outside surface of the bar 34 during movement. In addition, the upper clamp plate 98 of the transverse clamp mechanism 88 can be constructed so as to apply a spring-like force against the glide inserts 96, 102 when the screws 104 are tightened. Thus, the upper clamp plate 98 acts like a spring and pushes against the glide inserts 96, 102 to help hold the bar 34 in place until the user applies a force greater than the holding force to move the bar 34 relative to the transverse clamp mechanism 88. As an example, the upper clamp plate 98 can be made from a plastic material embedded with a glass filler. A high content of glass filler renders the upper clamp plate 98 stiff and prevents the plastic from creeping over time. Other examples include, but are not limited to, a spring steel or a plastic with an embedded spring steel plate. Any material, singular or compound, that imparts a spring-like squeezing force to the glide inserts 96, 102 is acceptable.

Figure 7:
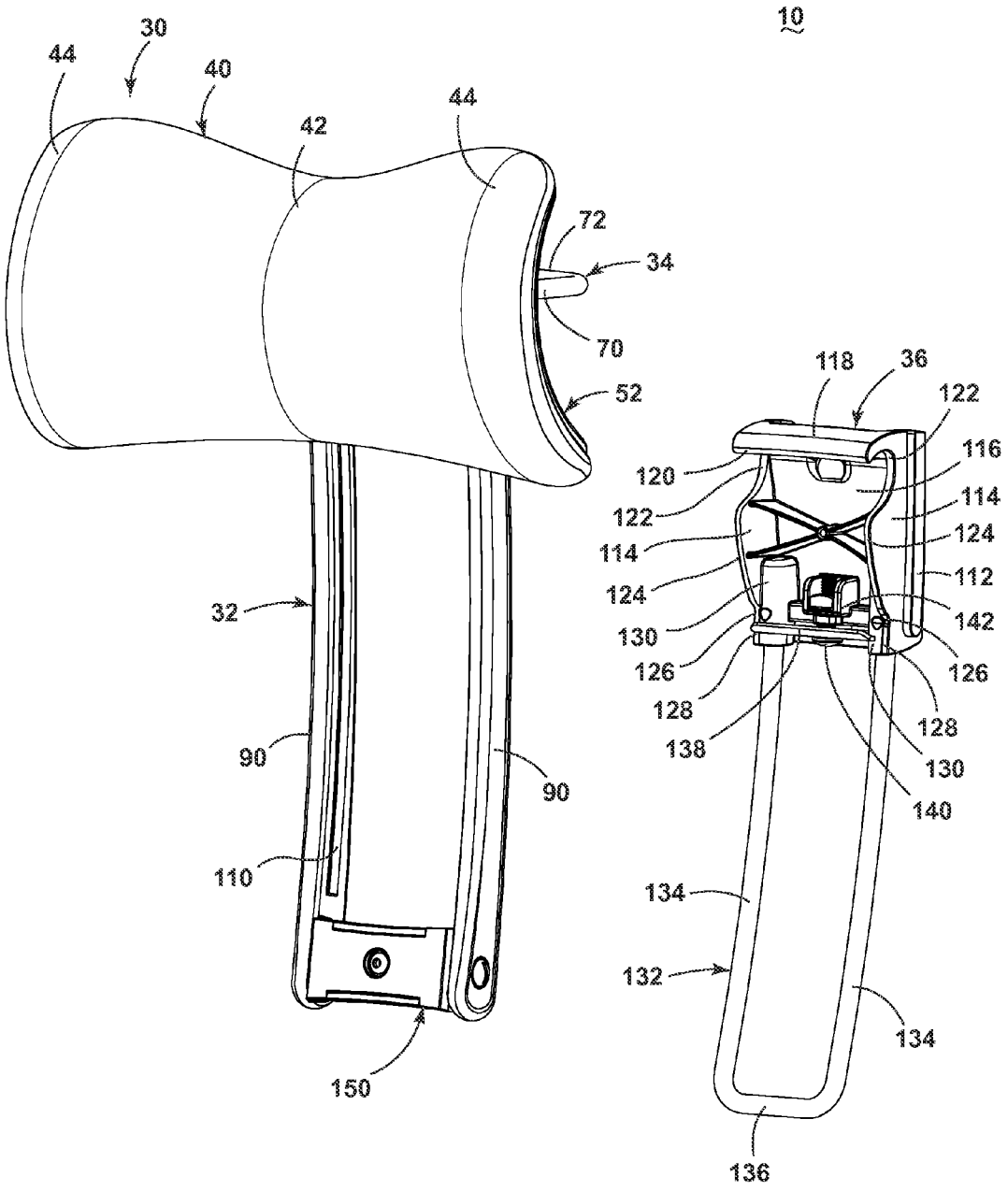
FIG. 7 is a front perspective view of the head rest assembly of FIG. 1 with a mounting bracket and U-shaped bar shown as exploded.

With continued reference to FIG. 6, the upright support arms 90, which have a fork-like configuration and a slight curvature, each include a track 110 along an inside surface thereof such that the tracks 110 face one another. The tracks 110 begin at the top of the arms 90 and terminate near but are spaced from the bottom of the arms 90. The mounting bracket 36 sits between the arms 90 and can slide along the arms 90 due to elongated keys 112 on side walls 114 of the bracket 36 being slidably received within the respective tracks 110. The keys 112 are best viewed in FIG. 7, which is a front perspective view of the head rest assembly 10 with the mounting bracket 36 exploded from the upright support 32. The side walls 114 are joined by a rear wall 116 and an upper wall 118 forming an upper clamp 120 at a forward end thereof. Further, the forward edge of the side walls 114 is contoured to form, from its upper to lower ends, a relatively large upper notch 122, a protrusion 124, a relatively small lower notch 126, and straight portion 128. The forward edge of the side wall 114 is configured in accordance with the structure to which the head rest assembly 10 is mounted, which, in this example, is the upper portion 18 of the chair back frame 16 (FIG. 1). The bracket 36 further includes a pair of generally cylindrical bar mounts 130 adjacent the side walls 114 and sized and shaped to fixedly receive a U-shaped bar 132, particularly free ends of legs 134 of the bar 132. The bar 132, which includes a bight 136 connecting the legs 134 at the end opposite the free ends, extends downward between the arms 90 and has a slight curvature similar to the curvature of the arms 90. In addition, the bracket 36 includes a lower clamp 138 located between the bar mounts 130 and below the lower notches 126 on the forward edge of the side walls 114 and held in position by a mechanical fastener, such as a bolt 140, anchored by a bolt receiver 142 extending forward from the rear wall 116 above the lower clamp 138.

Figure 8:
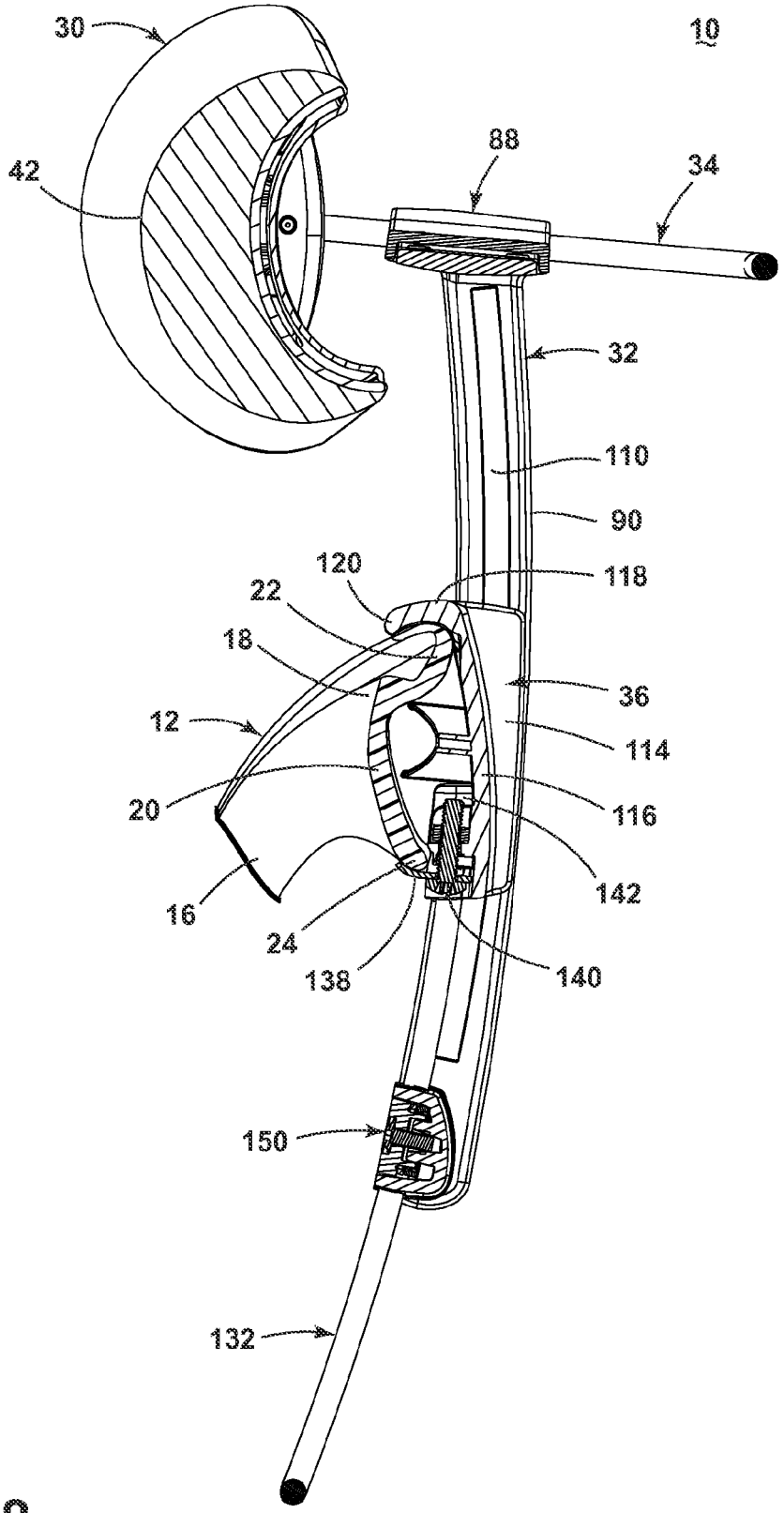
FIG. 8 is a sectional view taken along line VIII-VIII of FIG. 2.
Figure 9:
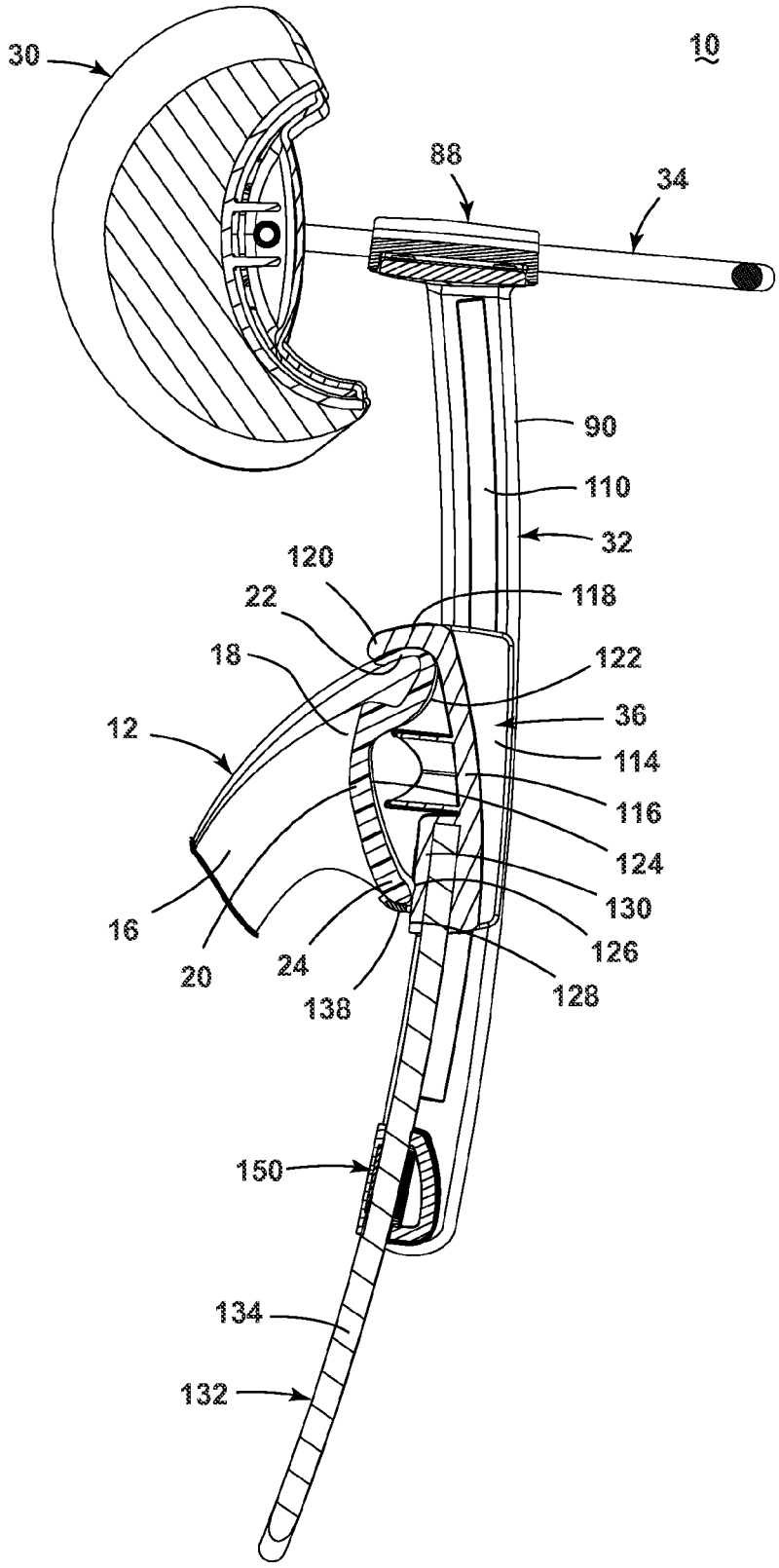
FIG. 9 is a sectional view taken along line IX-IX of FIG. 2.

Coupling of the mounting bracket 36 to the chair 12 is shown in the sectional views of FIGS. 8 and 9 taken along lines VIII-VIII and IX-IX, respectively, of FIG. 2. In FIG. 8, which is taken along the vertical center of the head rest assembly 10, it can be seen that the bracket 36 clamps onto the upper portion 18 of the chair back frame 16. Specifically, the upper clamp 120 rests on top of the frame upper lip 22, and the lower clamp 138 resides under the frame lower lip 24. With the frame 16 positioned as such between the upper and lower clamps 120, 138, the bolt 140 can be tightened to raise the lower clamp 138 and, thereby, firmly clamp the bracket 36 onto the frame 16. As shown in FIG. 9, the various elements of the forward edge of the bracket side walls 114 mate with corresponding features of the chair back frame 16. Moving up to down, the upper notch 122 receives the upper lip 22, the protrusion 124 complements the arcuate wall 20, and the lower notch 126 receives the lower lip 24.

Figure 10:
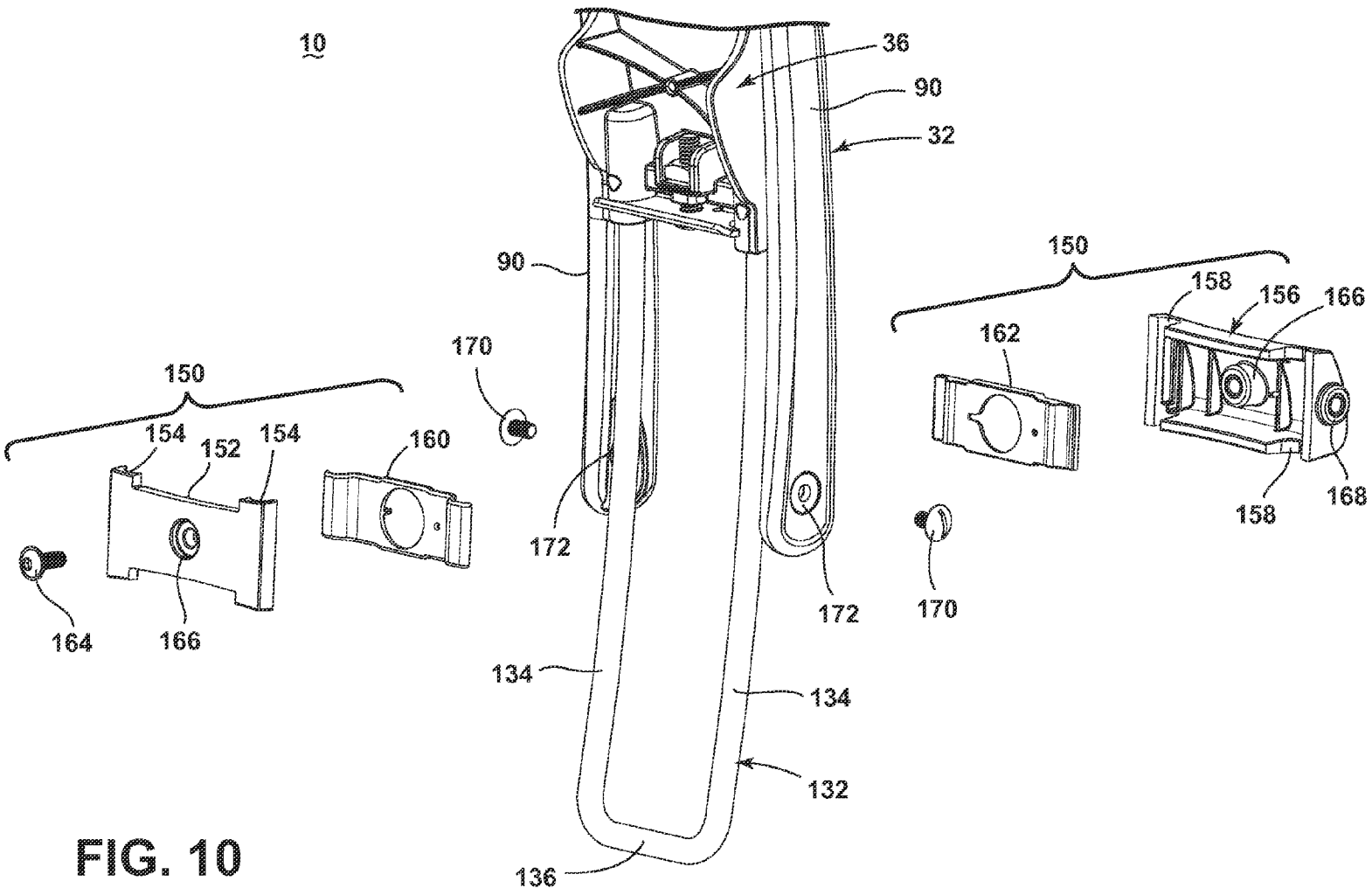
FIG. 10 is partial front perspective view of the head rest assembly of FIG. 1 with an upright clamping mechanism shown as exploded.

Referring now to FIG. 10, the upright support 32 supports an upright clamp mechanism 150 mounted between the arms 90 at the lower end thereof. A front clamp plate 152 of the upright clamp mechanism 150 forms a pair of channels 154 spaced a distance about equal to the spacing of the bar legs 134. A rear clamp plate 156 also forms a pair of channels 158 with the same spacing. Further, the front and rear clamp plates 152, 156 each hold a glide insert 160, 162 having portions received within the respective channels 154, 158, which can be recessed or otherwise configured to receive the respective glide inserts 160, 162, for facilitating smooth movement of the bar 134 within the channels 154, 158, similar to the glide inserts 96, 102 of the transverse clamp mechanism (FIG. 6). Additionally, a mechanical fastener, such as a screw 164, secures the front and rear clamp plates 152, 156 together; the screw 164 extends through an aperture 166 in the front clamp plate 152 and into a screw boss 166 on the rear clamp plate 156. The screw 164 is secured in the screw boss 166 by a standard thread locking adhesive. The rear clamp plate 156 also includes a screw boss 168 on both sides thereof for receiving a mechanical fastener, such as a screw 170, inserted through apertures 172 on the lower end of the arms 90 to fixedly mount the upright clamp mechanism 150 to the upright support 32. The channels 154 on the front clamp plate 152 mate with the corresponding channels 158 on the rear clamp plate 156, and the two sets of the mating channels 154, 158 form a pair of generally circular spaces within which the bar legs 134 sit (FIGS. 2 and 6). Referring back to FIG. 2, the vertical position of the head rest 30, relative to the chair in a generally upright orientation, can be adjusted by sliding the upright clamp mechanism 150 relative to the bar 132 and the bracket 36, which is mounted to the chair 12. As the upright clamp mechanism 150, and, thereby, the upright support 32, moves up and down to adjust the vertical position of the head rest 30, the bar legs 134 can slide within the channels 154, 158. The screw 164 sets the sliding/holding or frictional force to move/hold the head rest 30 vertically and can be tightened or loosened to increase or decrease, respectively, the clamping force on the bar 132. As the clamping force increases, the force required to move the head rest 30 vertically increases (i.e., force holding the head rest 30 in the vertical position increases), while the force required to move the head rest 30 vertically decreases as the clamping force decreases (i.e., force holding the head rest 30 in the vertical position decreases). The upright clamp mechanism 150 essentially forms a frictional joint between the upright support 32 and the bar 132 that is an extension of the bracket 36, and adjusting the screw 164 adjusts the amount of friction that holds the upright support 32 in place in normal use and that must be overcome to move the upright support 32 relative to the bar 132 and, therefore, the bracket 36. Typically, the tension in the clamping force is set to maintain the head rest 30 in adjusted position when in normal use but so that the sliding movement of the head rest 30 from the desired vertical position can be effected by solely applying user force directly to the head rest 30 to overcome the selected frictional resistance force without the use of tools and without adjusting the frictional resistance force. Optionally, the screw 164 can be sufficiently tightened to effectively lock the head rest 30 in a desired vertical position relative to the chair in a generally upright position.

As described above with respect to the transverse clamp mechanism 88, the glide inserts 160, 162 can be made of a self-lubricating plastic, and the front clamp plate 152 of the upright clamp mechanism 150 can be constructed so as to apply a spring-like force against the glide inserts 160, 162 when the screw 164 is tightened.

To use the head rest assembly 10, a user mounts the assembly 10 to the chair 12 with the bracket 36. As seen in FIGS. 8 and 9, the upper clamp 120 of the bracket 36 is placed onto the upper lip 22 of the chair back frame 16, which is inserted into the bracket upper notches 122. At the same time, the lower lip 24 of the chair back frame 16 is placed into the bracket lower notches 126, and the arcuate wall 20 joining the upper and lower lips 22, 24 rests against the protrusions 124. The lower clamp 138 of the bracket 36 is positioned under the lower lip 24 and raises upon tightening of the bolt 140. The user tightens the bolt 140 until a desired clamping force holds the chair back frame 16 between the upper and lower clamps 120, 138. The configuration of the mounting bracket 36 enables the head rest assembly 10 to be mounted to the chair 12 without damaging or modifying the chair 12, such as by requiring holes to be made in the chair 12. The bracket 36 of the illustrated embodiment can be mounted to the chair 12 without the use of tools and can also be easily removed from the chair 12 without the use of tools.

Figure 11:
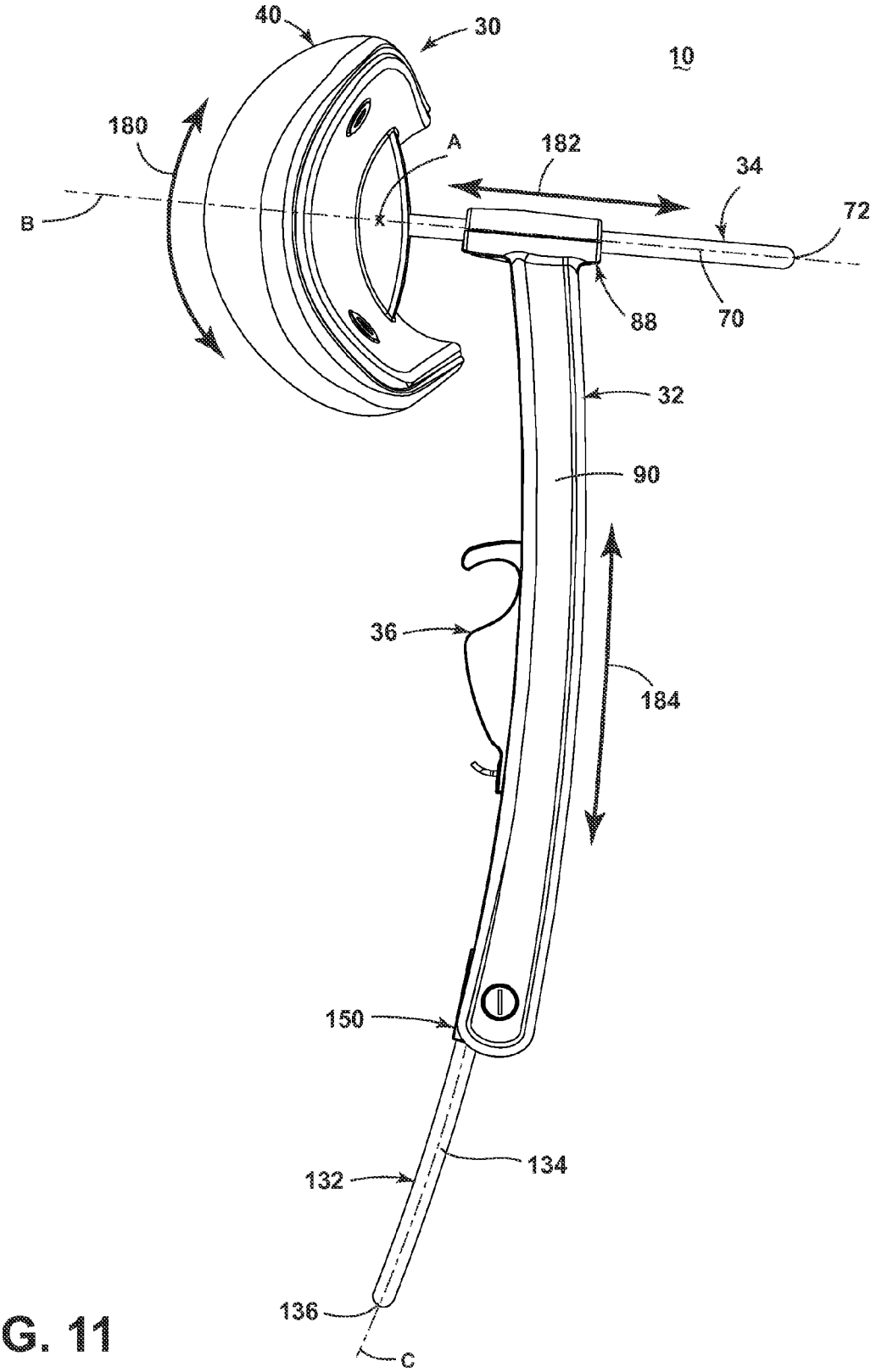
FIG. 11 is a side view of the head rest assembly of FIG. 1 illustrating pivotal, horizontal, and vertical adjustment of the head rest with the head rest assembly in a generally upright position.

Once the head rest assembly 10 is mounted to the chair 12, the user can adjust the position of the head rest 30 as desired in any or all of three manners: pivotal/rotational, horizontal, and vertical adjustment with respect to the chair in a generally upright orientation. Referring again to FIG. 5, regarding pivotal adjustment of the head rest 30, the user turns the screws 76, accessible through the apertures 64, to set the tension in the pivot connection between the head rest 30 and the bar 34 to a desired amount. Once the desired pivotal tension is obtained, the pivotal tension remains constant, providing smooth rotation as desired by the user. The user can then pivot the head rest 30 about a pivot axis A at the ends of the bar 34, as indicated by an arrow 180 in the side view of the head rest assembly 10 in FIG. 11. If the user is sitting in the chair 12, the user may reach behind the head and grasp the sides, and/or other portions, of the head rest 30 for imparting rotational force to effect the pivotal movement. Locking, although feasible by tightening the screws 76, is not required; tension holds the head rest 30 in position. The tension adjustment is for setting up the head rest assembly 10 only and need not be repeated unless the user desires a different amount of pivotal tension.

Referring again to FIG. 3, regarding horizontal or transverse adjustment the head rest 30, the user turns the screws 104 to set the clamping force applied to the legs 70 of the bar 34 by the transverse clamping mechanism 88. The clamping force should be set to a level that allows a user to slide the bar 34 to change the horizontal or transverse position of the head rest 30 without the use of tools and without adjusting the clamping force yet retains the head rest 30 in the desired position without slipping. Once the clamping force is set, the user can then slide the bar 34 along an axis B forward and backward, as indicated by an arrow 182 in FIG. 11, to reach a desired fore-aft position. If the user is sitting in the chair 12, the user may reach behind the head and grasp the sides, and/or other portions, of the head rest 30 for imparting a pushing or pulling force to effect the sliding movement. Further, if the user desires to move the head rest 30 rearwards (i.e., toward the chair back 14), the user may apply force in that direction by pushing the user's head against the head rest 30 rather than by pushing with the user's hands. Because of the angled orientation of the bar 34 and the horizontal clamp mechanism 88 relative to the upright support 32, the transverse movement of the bar 34 will also result in a slight contemporaneous vertical movement of the head rest with respect to the chair 12, the amount of which depends on the magnitude of the angular relationship of the bar 34 with respect to the upright support 32. If the user is not sitting in the chair 12, the user can optionally grasp the bight 72 of the bar 34 and use it as a handle during the horizontal adjustment of the head rest 30. Optionally, although not necessary, the user can lock the head rest 30 in a desired position by turning the screws 104 to increase the clamping force applied by the transverse clamping mechanism 88 a sufficient amount to prevent sliding movement of the bar 34.

Referring again to FIG. 2, regarding vertical adjustment of the head rest 30, the user turns the screw 164 to set the clamping force applied to the legs 134 of the bar 132 by the upright clamping mechanism 150. The clamping force should be set to a level so that a user can optionally overcome the static frictional resistance to slide the upright support 32 relative to the bar 132, which is fixedly attached to the chair 12, to change the vertical position of the head rest 30 without the use of tools yet retains the head rest 30 in the desired position without slipping. Once the clamping force is set, the user can then slide the upright support 32 along an axis C up and down, as indicated by an arrow 184 in FIG. 11, relative to the bracket 36 and the bar 132, which are mounted to the chair 12. If the user is sitting in the chair 12, the user may reach behind the head and grasp the sides, and/or other portions, of the head rest 30 for imparting an upward or downward force to effect the sliding movement. Because of the curvature of the arms 90 of the upright support 32, up and down movement of the upright support 32 will also result in a slight contemporaneous transverse movement of the head rest 30, the amount of which depends on the degree of curvature in the arms 90. If the user is not sitting in the chair 12, the user can optionally grasp the upright clamping mechanism 150 and use it as a handle during the vertical adjustment of the head rest 30. Optionally, although not necessary, the user can lock the head rest 30 in that position by turning the screw 170 to increase the clamping force applied by the upright clamping mechanism 150 a sufficient amount to prevent sliding movement of the upright support 32.

It can be seen that once the head rest assembly 10 is mounted to the chair 12, and the tension of the pivot connection at the screws 76 and the clamping forces applied the bars 34, 132 by the clamping plates 98, 152 through the screws 104, 164, respectively, are set to suitable levels that permit rotational, horizontal, and vertical adjustment of the head rest 30 yet maintain the desired position of the head rest 30, the user can adjust the head rest 30 as needed while sitting in the chair 12 and without the need for tools or moving actuators, such as knobs and levers. The user simply grasps the head rest 30 with the hands and moves the head rest 30, such as by pivoting, sliding forward and/or rearward, and/or sliding upward and/or downward, until the head rest 30 achieves the desired position. As mentioned above, the user can use the head to push the head rest 30 rearward, if desired. To move the head rest 30 in any of the three manners of adjustment, the user simply needs to apply enough force to override the static frictional forces described above for the corresponding type of adjustment, e.g., rotational, horizontal, and/or vertical. The head rest 30 will remain in the desired position without any further action of the user (i.e., no interaction with knobs, levers, screws, etc.) until the user applies a sufficient force again. The tension and clamping forces (i.e., holding forces) need not be adjusted again once they are set, unless the user prefers a different holding force or wishes to lock the head rest 30 in position such that it cannot be adjusted unless the tension and/or clamping forces are adjusted. Further, the head rest assembly 10 may be provided to the user with the holding forces preset, such as during assembly in the factory, according to those which are found to be suitable for an "average" user so that the holding forces need only be adjusted or set by the user if the user is above or below the size of the "average" user.

Another way to characterize the head rest assembly 10 is: the head rest 30 mounted to the chair 12 by a support that includes the bracket 36, the upright support 32, the transverse support 132, and the structures connecting these elements and connecting the support to the head rest 30. The support, therefore, includes three friction joints: a first friction joint at the upright clamp mechanism 150, a second friction joint at the transverse clamp mechanism 88, and a third friction joint—a pivot friction joint—at the connection between the head rest 30 and the transverse support 132. Each of these friction joints frictionally holds the head rest 30 in a certain position: the first friction joint holds the upward-downward position of the head rest 30, the second friction joint holds the forward-rearward (i.e., fore-aft) position of the head rest 30, and the third friction joint holds the rotational position of the head rest 30. These positions are frictionally held until the user applies a force greater than the corresponding frictional forces resulting from the tension applied at the clamping mechanisms 88, 150 and at the pivot connection of the head rest 30 by the respective screws 104, 164, 76. The holding forces remain constant during the adjustment of the head rest 30 such that the position to which the head rest 30 has been adjusted is held upon release of the force(s) applied by the user to overcome the holding force(s). The user does not need to tighten any levers, knobs, or other actuators to retain the position of the head rest 30.

With the head rest assembly 10 mounted to the chair 12 and adjusted as desired by the user in the pivotal/rotational, horizontal or transverse, and/or vertical manners, the user can sit in the chair 12 with comfortable support for the head. The head rest 30 can be positioned such that the head and/or neck rests against the cushion 40. The neck (i.e., the cervical spine) supports the head, which weighs around eight pounds. The neck requires little support for itself but does require some support because of its connection to the head. The head can be supported directly and will, in turn, support the neck because of the connection to the neck. In practice, people often choose to place the head rest at the juncture between the top of the cervical spine and the head (i.e., the "crook of the neck"), thus supporting both directly. However, the above head rest assembly 10 provides support of any part of the head and neck. As the user reclines toward a supine position in a chair, support for the head becomes far more important, since the position of the head requires more muscular support as it loses skeletal support.

The embodiment described above and shown in the figures can be modified in any suitable manner. For example, the head rest assembly can be configured to include only one or two manners in which to adjust the head rest, such as only pivotal adjustment, only horizontal or transverse adjustment, only vertical adjustment, and a combination of two types of adjustment. Further, the head rest assembly can be mounted to the chair in any suitable manner and is not limited to the mounting bracket disclosed herein. A different type of clamping bracket, another type of bracket, or a connection lacking a bracket may be employed. Alternatively, the head rest assembly can be integrally formed with the chair rather than being removably mounted to the chair. Another type of head rest, including head rests of other shapes and sizes, may be used with the head rest assembly. Furthermore, the various clamping mechanisms and the pivotal connection can be modified such that the frictional forces of the head rest can be adjusted in other manners. Additionally, the configuration of the head rest, particularly the contoured surface of the cushion with variable radii of curvature, may be employed with other mounting mechanisms and other adjustment mechanisms. Conversely, the mounting and adjustment mechanisms may be used with other types of head rests. In addition, the head rest structure can be modified so a user can change the contour of the cushion of the head rest, thus providing a more customized fit. For example, the head rest cushion can be made, at least in part, of a material for the head rest cushion that changes contour in response to a user flexing the cushion by applying pressure to the cushion. Such pressure can be applied by squeezing the cushion in strategic locations and releasing the cushion until achieving the desired contour.

The above description has employed the terms "horizontal" and "vertical" to describe spatial orientation of some of the features of the head rest assembly 10. These terms are intended to identify the general orientation of these features when the chair 12 is in an upright (i.e., not reclined) orientation and do not limit such features to specific horizontal and vertical positions and orientations. In general, "vertical" refers to an upright position and orientation, while "horizontal" refers to a position and orientation transverse to the vertical.

Additionally, it has been noted that movement of the head rest 30 in the horizontal direction can result in some degree of contemporaneous vertical movement, and, similarly, that movement of the head rest 30 in the vertical direction can result in some degree of contemporaneous horizontal movement, depending on the angled orientation of the bar 34 and the curvature of the upright support arms 90. However, in the illustrated embodiment, the amount of contemporaneous movement is negligible compared to the amount of movement in the intended direction such that movement in the horizontal direction can be considered independent of movement in the vertical direction and that movement in the vertical direction can be considered independent of movement in the horizontal direction. It follows that the illustrated embodiment of the head rest assembly 10 is configured for independent movement of the head rest 30 along three axes: the pivot axis, the horizontal axis, and the vertical axis, when the chair 12 is in the upright position.

The head rest assembly 10 in the illustrated embodiment provides a wide range of adjustment. For example, the head rest 30 has approximately 18 cm (7 in.) of vertical adjustment and approximately 8 cm (3 in.) of horizontal adjustment, in addition to cushion contour adjustment by pivoting the head rest 30. Such an adjustment range has been found to be suitable for more than 95% of user types and sizes and all work postures and activities.

The head rest assembly 10 according to the invention thus has a range of adjustment, for example, approximately 7 inches of vertical adjustment, 3 inches of horizontal adjustment, and cushion contour adjustment, all of which is suitable for more than 95% of user types and sizes, and all work postures and activities. The head rest assembly 10 thus provides immediate, effortless, and intuitive adjustment of the head rest 30 through the full range of possibilities. It is adjustable while the user is in the seated position; it is attachable to the Aeron® chair without modification or damage to the chair. In addition, the head rest assembly 10 has three independent axes of movement.

In one sense, the head rest assembly 10 has a sort of floating adjustment—no locks, knobs or levers. The user simply grabs the head rest 30 and moves it up or down, and/or in or out, and the head rest 30 moves smoothly to the desired position, and when the user lets go, the head rest 30 holds its position. The settings to hold the position of the head rest 30 are typically factory set for average body weights. However, the user can optimize or tailor the setting for his or her preference by adjusting the force holding screws. For example, if the user is above average size, he or she can set the holding force higher, and vice-versa for people under average weight. To reposition the head rest 30, the user simply overrides the frictional holding force and repositions the head rest 30. Further regarding repositioning, hands free repositioning can be done by simply pushing rearward with the head to reposition the head rest 30. This constructions provides a mechanism for micro adjustment without interfering with the work process.

An important feature of the floating adjustments of the head rest assembly 10 is that it easily accommodates the user movement to many new positions. It is non-prescriptive in that it allows the user to choose what feels comfortable and change when it becomes uncomfortable.

While the invention has been specifically described in connection with certain specific embodiments thereof, it is to be understood that this is by way of illustration and not of limitation, and the scope of the appended claims should be construed as broadly as the prior art will permit.

What is claimed is:

1. A head rest assembly mountable to a chair comprising a seat and a chair back extending upwardly from the seat, the head rest assembly comprising:

an upright support;

a bracket coupled to the upright support and configured to mount to the chair back to mount the head rest assembly to the chair back with the upright support in a generally upright orientation when the chair back is in an upright position, wherein the upright support is coupled to the bracket for selective upward and downward movement relative to the bracket;

a transverse support slidably mounted to the upright support for forward and rearward movement relative to the upright support;

a head rest mounted to the transverse support above the chair back for supporting a head of a user sitting in the chair when the head rest assembly is mounted to the chair back, wherein the head rest can be adjusted upward and downward by moving the upright support relative to the bracket and adjusted forward and backward by moving the transverse support relative to the upright support, wherein the head rest is pivotally mounted to the transverse support, which constitutes a first friction joint, for rotational adjustment of the head rest with respect to the transverse support; wherein the upright support is mounted to the bracket with a second friction joint that selectively holds the head rest at a desired vertical position with a second selected frictional resistance force; and the bracket includes a downwardly extending bar, and the upright support includes a clamp that damps onto the bar to form the second friction joint between the upright support and the bracket.

2. The head rest assembly of claim 1 wherein the first friction joint selectively holds the head rest at a desired rotational position with a first selected frictional resistance force.

3. The head rest assembly of claim 1 wherein the transverse support is mounted to the upright support with a third friction joint that selectively holds the head rest at a desired horizontal position with a third selected frictional resistance force.

4. The head rest assembly of claim 3 wherein the transverse support comprises a bar, and the upright support includes a clamp that clamps onto the bar to form the third friction joint between the upright support and the transverse support.

5. The head rest assembly of claim 3, and wherein the first friction joint selectively holds the head rest at a desired rotational position with a first selected frictional resistance force.

6. The head rest assembly of claim 5 wherein the first, second, and third friction joints are adjustable so that the first, second and third selected frictional resistance forces can maintain the head rest in a desired position during normal use and so that a sliding movement of the head rest from at least one of a desired vertical position, a desired horizontal position, and a desired rotational position can be effected by solely applying user force directly to the head rest to overcome the corresponding selected first, second and third frictional resistance forces without the use of tools and without adjusting the frictional resistance forces.

7. The head rest assembly of claim 3 wherein the second and third friction joints are adjustable so that the second and third selected frictional resistance forces can maintain the head rest in a desired position during normal use and so that the sliding movement of the head rest from at least one of a desired vertical position or a desired horizontal position can be effected by solely applying user force directly to the head rest to overcome the corresponding selected frictional resistance forces without the use of tools and without adjusting the frictional resistance forces.

8. The head rest assembly of claim 1 wherein the bracket is configured to removably clamp onto an upper portion of the chair back to removably mount the head rest assembly to the chair back.

9. The head rest assembly of claim 1 wherein the head rest has an outer surface contoured to form, along a generally horizontal reference line, a concave center portion that transitions to convex outer portions so as to form a cradle at the center portion for receipt of the head or a neck of the user.

10. The head rest assembly of claim 9 wherein the outer surface is further convex along a generally vertical reference line at the center portion and at the outer portions.

11. The head rest assembly of claim 1 wherein the upright support comprises a pair of upright arms mounted to the bracket, and the transverse support comprises a U-shaped bar mounted to upper ends of the pair of upright arms.

12. The head rest assembly of claim 11 wherein the U-shaped bar comprises a bight that joins spaced, parallel legs, wherein the spaced, parallel legs are mounted to the pair of upright arms of the upright support, and the head rest is mounted to ends of the spaced, parallel legs opposite the bight.

13. The head rest assembly of claim 12 wherein the bracket includes a downwardly extending bar, and the pair of spaced, parallel legs of the assembly are mounted to the downwardly extending bar.

14. The head rest assembly of claim 13 wherein the spaced, parallel legs each include an inwardly facing track that slidingly receives the bracket.

* * * * *